United States Patent [19]

Hofbauer

[11] Patent Number: 4,470,377

[45] Date of Patent: Sep. 11, 1984

[54] INTAKE MANIFOLD FOR AN INTERNAL-COMBUSTION ENGINE WITH SPARK IGNITION

[75] Inventor: Peter Hofbauer, Wolfsburg, Fed. Rep. of Germany

[73] Assignee: Volkswagenwerk AG, Wolfsburg, Fed. Rep. of Germany

[21] Appl. No.: 272,179

[22] Filed: Jun. 10, 1981

[30] Foreign Application Priority Data

Jun. 14, 1980 [DE] Fed. Rep. of Germany ..... 3022447

[51] Int. Cl.[3] ..... F02B 29/02

[52] U.S. Cl. ..... 123/52 M; 123/308

[58] Field of Search ..... 123/308, 432, 52 M

[56] References Cited

U.S. PATENT DOCUMENTS 2,088,983 8/1937 Swennes ..... 123/52 M
2,099,785 11/1937 Willgoos ..... 123/52 M
3,054,390 9/1962 Meurer et al. ..... 123/308
3,635,201 1/1972 High ..... 123/52 M

FOREIGN PATENT DOCUMENTS 2815701 10/1979 Fed. Rep. of Germany .

*Primary Examiner*—William A. Cuchlinski, Jr.
*Attorney, Agent, or Firm*—Spencer & Frank

[57] ABSTRACT

An intake manifold for a spark-ignited internal-combustion engine including a distributor body from which the intake pipes leading to the individual combustion chambers of the engine branch off in a sequence corresponding to the firing order. The individual intake pipes depart, via branch lines, from more than one location of the distributor body. Preferably, the locations of the distributor body associated with a respective intake pipe are arranged in symmetry with respect to an axis of the distributor body.

3 Claims, 3 Drawing Figures

INTAKE MANIFOLD FOR AN INTERNAL-COMBUSTION ENGINE WITH SPARK IGNITION

BACKGROUND OF THE INVENTION

The present invention relates to an intake manifold for an internal-combustion engine with spark ignition. More particularly, the present invention relates to an intake manifold for such an engine including a distributor body from which the intake pipes leading to the individual combustion chambers of the engine branch off in a sequence corresponding to the firing order of the engine.

An intake manifold of the above-described type is disclosed in French Pat. No. 1,475,880, issued Feb. 27, 1967. Such an intake manifold offers advantages regarding the supply of the individual combustion chambers of the engine with the same fuel and air mixture as concerns quantity and ratio, particularly in an engine of the flat type (opposed cylinder type). In such engines, in which the cylinders are arranged in two rows, the customary firing order is 1-2-3-4 (or in the reverse sequence, respectively) with the cylinders 1 and 2 as well as the cylinders 3 and 4 being arranged to be successive in each cylinder row in the same direction. If, therefore, the intake manifold is not constructed so that the intake pipes branch off from the distributor body in a sequence corresponding to the firing order, the intake pipes, or the cylinders of each cylinder row, find completely different flow and mixture distribution conditions during intake. The two cylinders of a cylinder row take in at a crank angle spacing of 180°, and until the first cylinder of the cylinder row in question takes in again, there is a pause corresponding to a crank angle of 540°.

SUMMARY OF THE INVENTION

It is now the object of the present invention to further improve an intake manifold of the type described above with respect to regularizing the mixture components supplied to the individual combustion chambers.

The above object is achieved in that in an intake manifold for an internal combustion engine with spark ignition including a distributor body and a plurality of intake pipes leading to the individual combustion chambers of the engine and branching off from the distributor body in a sequence corresponding to the firing order of the engine, each of the intake pipes includes a plurality of branch portions which merge into a common portion (near the intake valve of the cylinder) and which branch off from the distributor body at respectively different locations.

Thus, by increasing the number of mixture discharge points or locations for the individual intake pipes, the present invention, in an advantageous manner, takes care that local differences in the composition of the mixture in the distributor body, as they may be caused, for example, due to structural tolerances or fluctuations in pressure and temperature, are averaged out.

According to further features of the invention, each intake pipe may have more than two branch lines or portions and all of the discharge locations associated with each intake pipe are arranged symmetrically with respect to the axis of the distributor body.

Finally, with regard to a further feature of the invention, it is initially pointed out that dual-conduit intake pipes which form separate channels for operation under partial load and under full load where the engine is fed through dual-conduit carburetors are known from German Offenlegungsschrift No. 2,815,701, laid open Oct. 26, 1979. In such an arrangement, the channel associated with operation under partial load is heated by exhaust gases in order to avoid precipitation of fuel along its walls. In the design of the intake pipes, it is likewise of advantage to have the two intake pipe channels open at different locations or mixture discharge points of the distributor body.

DETAILED DESCRIPTION OF THE PREFERRED EMBODIMENTS

Figure 1:
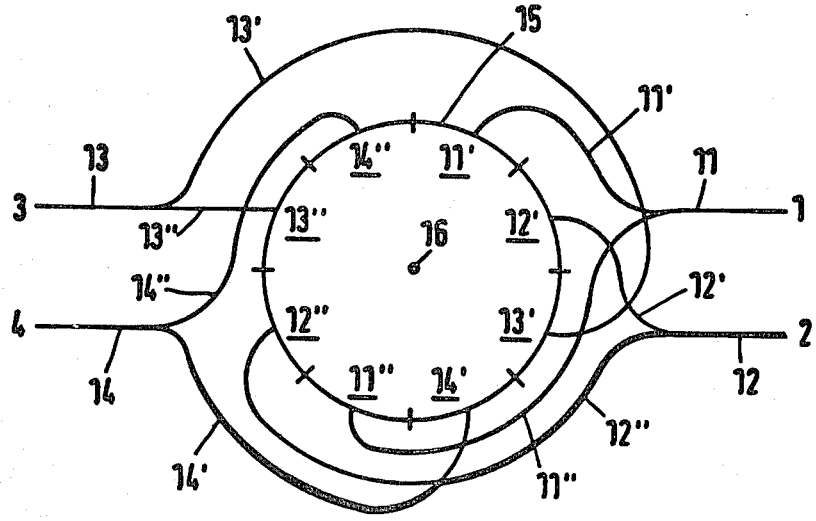
FIG. 1 is a schematic plan view of one embodiment of an intake manifold according to the invention.
Figure 2:
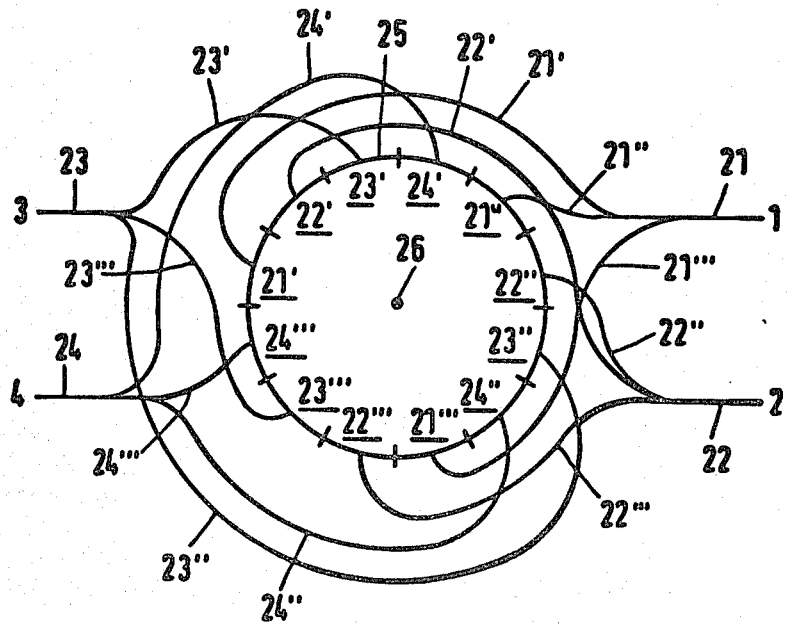
FIG. 2 is a schematic plan view of another embodiment of an intake manifold according to the invention.

FIGS. 1 and 2 schematically show two embodiments of an intake manifold (including a distributor and intake pipes) according to the invention for the case of a flat engine with a firing order of 1-2-3-4. The intake pipes leading to the cylinders 1, 2, 3 and 4 of the engine are identified in FIG. 1 by the reference numerals 11, 12, 13 and 14, respectively, and in FIG. 2 by the reference numerals 21, 22, 23 and 24, respectively.

Referring first to FIG. 1, each one of the intake pipes 11–14 opens into a distributor body 15 which is fed by a carburetor (not shown) disposed above the plane of the drawing. In this embodiment, each intake pipe includes a common portion identified by the reference numeral for the intake pipe and two branch lines or portions which are identified by apostrophies and which merge into the common portion. For example, intake pipe 11 has two branch lines 11' and 11'', intake pipe 12 has two branch lines 12' and 12'', etc.

In the distributor body 15, the locations or mixture discharge points where the individual branch portions or lines 11', 11'', 12' . . . 14'' branch off are indicated by the respectively same reference numeral which is underlined. For example, the discharge location of branch portion 12' is indicated by 12', of branch portion 13'' by 13'', etc.

It can initially be seen that the branch discharge locations or departures 11', 11'', 12' . . . 14'' associated with the individual intake pipes 11 through 14 follow one another in the same sequence as the firing order 1-2-3-4 of the engine, i.e., 11', 12', 13', 14', 11'' . . . 14''. Furthermore, the branch discharge locations or departures associated with each one of the intake pipes 11 through 14, e.g., the locations 11' and 11'' for the intake pipe 11, are arranged symmetrically to the longitudinal axis 16 of the distributor body 15 so that differences in the supplies of fuel mixture to the individual intake pipes 11–14 due to different conditions at individual locations in the distributor body 15 are prevented with great probability.

In the embodiment according to FIG. 2, wherein an intake manifold for a flat four-cylinder engine is likewise involved, the individual intake pipes 21 through 24 again include a plurality of branch lines or portions which are connected with different locations or discharge points of the distributor body 25. However, in this embodiment, each intake pipe is provided with a larger number of branch lines or portions than in the emb .diment of FIG. 1. That is, in FIG. 2, each intake pipe is provided with three branch lines or portions which again are identified by apostrophies. The individual branch lines or portions 21', 21'', 21''' to 24', 24'', 24''' depart from respective locations or discharge points in the distributor body 25 which locations are identified by the correspondingly apostrophied numerals which are additionally underlined.

It can again be seen that the points of departure or discharge to the individual cylinders via the respective branch lines follow one another in a succession corresponding to the firing order. Moreover, the respective points of departure or discharge locations associated with each one of the intake pipes 21–24 are arranged in symmetry with respect to the longitudinal axis 26 of the distributor body 25, e.g., the locations 21', 21'' and 21''' associated with intake pipe 21, so that possibly existing differences in the mixture in different regions of the distributor body 25 can be averaged out even better than in the embodiment according to FIG. 1.

The branch line arrangement according to the embodiment of FIG. 1 may also be utilized with dual-conduit intake pipes, where one of the channels of each intake pipe supplies the fuel mixture during operation under low load and number of revolutions, while the other channel is used during operation with greater load.

Figure 3:
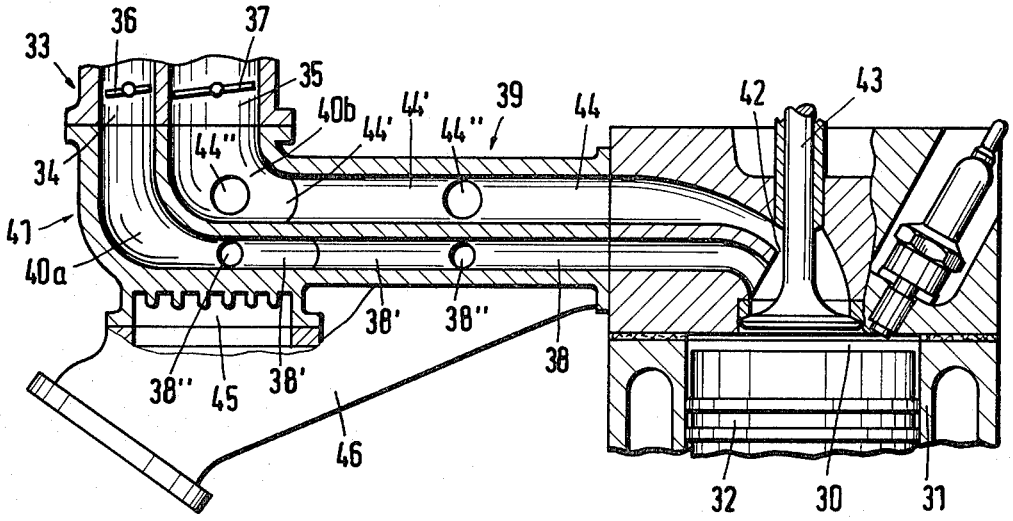
FIG. 3 is a longitudinal section of an engine equipped with the invention and having a two-stage carburetor with each stage generating a fuel-air-mixture for high or low load, respectively.

FIG. 3 shows an embodiment of the invention for this type of engine. The combustion chamber 30 formed by cylinder 31 and piston 32, and the other combustion chambers of the engine not shown in the drawing, are furnished with combustible fuel-air-mixture by carburetor 33 having two stages, that is two manifolds 34 and 35 with throttle valves 36 and 37. Throttle valve 36 opens at low loads, while throttle valve 37 opens at higher loads of the engine as is well known in the art. Consequently at low loads a mixture from the low-load-part 40*a* of distributor body 41 is delivered, via channel 38 of intake pipe 39, to the common portion 42 of intake pipe 39 near the intake valve 43, while at higher loads the mixture flows from high-load-part 40*b* of distributor body 41 through channel 44 of intake pipe 39 having a larger cross-section than channel 38. The low-load-mixture is heated via hot-spot 45 by the exhaust gases of the engine flowing through exhaust line 46 which also contacts channel 38 at the lower side thereof.

Each of the channels 38 and 44 contains branch portions 38' and 38'' or 44' and 44'', respectively, which branch off from the distributor body 41 at different points 38' and 38'' or 44' and 44'', respectively. In the drawing the actual branch portions 38'' and 44'' lie behind branch portions 38' and 44'. In this way, in an engine equipped with a two-stage carburetor, local differences of the mixture in the distributor body are averaged out.

It is to be understood that the above description of the present invention is susceptible to various modifications, changes and adaptations, and the same are intended to be comprehended within the meaning and range of equivalents of the appended claims.

What is claimed is:

1. In an intake manifold for a spark-ignited internal-combustion engine, said manifold including a distributor body having a longitudinal axis and a plurality of intake pipes leading to the individual combustion chambers of the engine and branching off from said distributor body in a sequence, around said axis, corresponding to the firing order of the engine; the improvement wherein: each of said intake pipes includes a plurality of branch portions which merge into a common portion leading to the associated said individual combustion chamber and which branch off from said distributor body at respectively different locations; and, said locations for said plurality of intake pipes branch off from said distributor body, in one revolution around said axis, in a plurality of consecutive sequences, each corresponding to said firing order of the engine.

2. An intake manifold as defined in claim 1 wherein said locations of said distributor body associated with each respective said intake pipe are arranged in symmetry with respect to said axis of said distributor body.

3. An intake manifold as defined in claim 1 or 2 wherein each of said intake pipes, including its branch portions, is a dual-conduit intake pipe having separate channels for operation of the engine under small and large loads.

* * * * *